US005309337A

United States Patent [19]

Groben

[11] Patent Number: 5,309,337

[45] Date of Patent: May 3, 1994

[54] TWIST-ON/TWIST-OFF FLASHLIGHT WITH SHOCK-MOUNTED BULB ASSEMBLY AND REDUNDANT OFF-SWITCHING, PARTICULARLY FOR USE AT THE TIP OF POLICE BATONS

[76] Inventor: Steven Groben, 850 Daisy St., Escondido, Calif. 92027

[21] Appl. No.: 918,848

[22] Filed: Jul. 21, 1992

[51] Int. Cl.[5] ..... F21L 7/00

[52] U.S. Cl. ..... 362/206; 362/203; 362/188

[58] Field of Search ..... 362/206, 205, 203, 102, 362/202, 109, 188, 157; 200/60

[56] References Cited

U.S. PATENT DOCUMENTS

| | | | |
|---|---|---|---|
| 1,487,983 | 3/1924 | Stiriss | 362/206 |
| 4,581,686 | 4/1986 | Nelson | 362/205 |
| 4,888,670 | 12/1989 | Sharrah | 362/205 |
| 4,899,265 | 2/1990 | Maglica | 362/205 |
| 5,121,308 | 6/1992 | Maglica et al. | 362/206 |

*Primary Examiner*—James C. Yeung
*Attorney, Agent, or Firm*—William C. Fuess

[57] ABSTRACT

Two, redundant, electrical switches in electrical series between a flashlight's battery and its bulb are simultaneously activated by an angular rotation between two sections of the flashlight's case. To implement one of the switches the functions of (i) force biasing and (ii) electrical conduction between a battery's terminal and the flashlight case are separated. Force biasing between battery and case transpires by a spring and washer which are, in combination, electrically non-conducting. Electrical conduction between battery and case transpires by another, separate, spring that is shorter than the force-biasing spring. Further, and independently, a removable and replaceable combination shock-mounted light bulb and reflector assembly includes (i) a wire-lead miniature light bulb of low inertial mass encapsulated within (ii) a shock-absorbing plastic matrix which is further sleeved in (iii) a strong metal which also presents a reflector surface precision aligned to the bulb. The entire assembly is easy to handle and exhibits superior (i) mechanical alignment, strength, and damage resistance, and (ii) electrical connectivity, when placed and replaced within a flashlight of complimentary construction.

25 Claims, 3 Drawing Sheets

TWIST-ON/TWIST-OFF FLASHLIGHT WITH SHOCK-MOUNTED BULB ASSEMBLY AND REDUNDANT OFF-SWITCHING, PARTICULARLY FOR USE AT THE TIP OF POLICE BATONS

BACKGROUND OF THE INVENTION

1. Field of the Invention

The present invention generally concerns apparatus for coercive intervention—particularly batons and rugged flashlights —that are usable by law enforcement and like personnel to manipulate the environment, including human actors within the environment.

The present invention particularly concerns a flashlight that is especially rugged in each of its (i) bulb mounting and its (ii) positive on/of f actuation (particularly by a twisting motion) so as to be mountable at the end of a police baton and thereafter usable by the police for all normal functions of both (i) the baton and (ii) the flashlight.

2. Background of the Invention

A police baton, having ancient antecedents in the simple club, is a classic weapon within the police arsenal. Police are trained in use of the baton. The baton is a useful device variously facilitating the inspection of items, the guidance or signalling of persons including suspects and other police, and the use of force against persons and objects. Modern batons are often made of metal, and may be telescoping such as is shown in U.S. Pat. Nos. 4,752,072 issued Jun. 21, 1988, and 5,110,375 issued May 5, 1992.

Meanwhile, criminals have always sought the obscuring cloak of darkness, and criminal activity generally peaks at night. Many forms of criminal activity that are currently, circa 1992, prevalent in the United States of America involve trade in illegal drugs, or criminals who have ingested illegal drugs. Because of the illegality of selling or consuming illegal drugs, both sales and consumption are commonly conducted during the hours of darkness, and in locations that are poorly illuminated.

Still other, more traditional, criminal activities such as theft are common at night, and are commonly conducted with no or minimal illumination. Indeed, the crime of burglary was defined in the common law as unauthorized entrance into a dwelling house at night with an intention of thievery. This definition of the crime of burglary, and the severe punishments for its perpetration, recognize the special severity, and the special difficulties, of preventing or interdicting crime during the hours of darkness.

Because of the responsibilities of the police to curb criminal activity during darkness, and in dark places, special, rugged, flashlights are commonly issued to police. The police flashlight has considerably improved during recent decades. Modern police flashlight cases are strong, and may be suitably used as clubs. The emitted light is considerably brighter, and is often longer-lasting, than was previously the case. The advent of quartz-halogen light sources has particularly benefitted the police flashlight, which is, in certain cases, desired to emit a very bright, nearly blinding, light beam.

Police flashlights can, under certain circumstances, be used for signaling and for striking similarly to the uses of a police baton.

Possibly because of the potentially similar uses of a police baton and a police flashlight, and because of the similar tubular shapes and elongate aspect ratios of both devices, it has been from time to time suggested that the functions of the two devices might combined. The combination of a police baton and a police flashlight is an interesting concept in that it could potentially increase the utility of both the baton and the flashlight.

One unavoidable problem with the existing police flashlight, even one emitting a very bright light, is that the policeman holding the flashlight must identify his location. There is usually a time delay between a policeman's energizing of his/her flashlight and his/her visual fixation of any person or persons that may be within the flashlight's illuminating beam. There is a further time delay while the policeman, who may be attempting to aim his/her flashlight with a one hand while protecting himself/herself with a loaded weapon in the other hand, interprets the illuminated scene. During these time delays, which may be only momentary, the policeman is in jeopardy of being shot without warning by the party(ies) illuminated, or even by other parties who are still concealed by darkness.

Because of these obvious risks, and tensions, the literal shining of light on criminal activity is, in America circa 1992, a hazardous activity. If a flashlight could be located at the end of baton then a policeman could use the flashlight beam to illuminate suspicious activities or objects while the source of the light beam was more substantially distanced from the policeman's body. If an illumination from the beam of a flashlight at the end of a police baton were to elicit a hostile response then the policeman would already, and conveniently, be armed with at least the baton.

Alternatively, attachment or other integration of a flashlight with a baton facilitates and improves use of the flashlight because the flashlight may be more conveniently brought proximate to objects which are desired to be illuminated, or the flashlight may be inserted through small spaces into dark areas.

Whether a police baton is hypothesized to incorporate the function of a flashlight, or a police flashlight is hypothesized to be reconfigured so as to more substantially incorporate the function of a baton, any quality consolidation of the functions of both devices presents certain challenges.

A combination police baton and flashlight would desirably be fully as functionally capable as either a (i) police baton, or a (ii) police flashlight individually. In order to realize the baton function both the mechanical and electrical sections, including the bulb, of a flashlight must be so rugged, or hardened, so as to permit that the flashlight may be stuck against objects with great force without appreciable risk of failure. This must be accomplished without, in particular, making the electrical sections of a flashlight so large or so massive so as to detract from the normal aspect ratio, and balance, of a baton. Nonetheless to its occasional use for striking, a combination police baton and flashlight would desirably turn on and of f easily and reliably during all conditions and histories of use and misuse.

Conversely, in order to realize a the function of a flashlight, a baton, especially a lightweight collapsible telescoping baton, must incorporate, or be integrated with, the function of a flashlight without a degrading its essential purpose. This likely requires, in particular, that neither the weight, strength, balance, rigidity, hardness nor grip (finish) of the baton should be appreciably altered.

The present invention will be seen to concern certain improvements in flashlights. The improvements, although of general applicability to rugged flashlights such as are used by police, are particularly directed to making flashlights that are fully capable of being integrated with police batons in order to constitute a combination baton-and-flashlight apparatus, and weapon, having excellent characteristics, and effectiveness, in both its baton and its flashlight functions.

SUMMARY OF THE INVENTION

The present invention contemplates a flashlight having two, redundant, series-connected electrical switches in an electrical path between the flashlight's battery and its bulb. Both switches are simultaneously activated by angular rotation between two sections of the flashlight's case. Although each switch is highly reliable, the predominant failure mode of each is a "stuck on" condition. Because the two switches are in electrical series, both must fail "stuck on" before the flashlight is incapable of being turned off.

The present invention further, and independently, contemplates a removable and replaceable combination shock-mounted light bulb and reflector assembly f or a flashlight. A wire-lead miniature is light bulb of low inertial mass—which miniature bulb would be difficult to handle and to electrically connect individually—is encapsulated within a shock-absorbing plastic matrix which is further sleeved in strong metal. The composite assembly, including a reflector surface precision aligned to the bulb, is easy to handle during placement and replacement within a flashlight case of complimentary construction. The assembly accords superior (i) mechanical alignment, support, shock isolation and damage resistance, and (ii) reliable electrical connectivity, of the bulb.

In accordance with the first, electrical switching, aspect of the present invention, another, second, electrical on/off switch is added to a twist on/twist off flashlight that already possesses one on/off switch. Typically such a preexisting flashlight has a tubular case with two electrically-conducting sections. The two sections screw together along insulating surfaces until, the relative angular rotation between the two sections exceeding a predetermined first degree, electrically conductive surfaces upon the two sections are placed into electrical contact. A light bulb is located within a first end portion of the two-section tubular case. The bulb has two terminals, a first one of which is in continuous electrical contact with a first section of the two-section tubular case. A battery is located, and moveable, within an opposite end portion of the two-section tubular case. The battery also has two terminals. A spring force biases the battery for movement within the tubular case so that a first one of its two terminals is in continuous electrical contact with a second terminal of the light bulb. The spring also electrically connects the second terminal of the battery to the second section of the two-section tubular case.

By this conventional construction any angular rotation of the flashlight's two sections that exceeds some predetermined first degree will place the two electrically-conducting sections of the tubular case into electrical contact. This contact completes an electrical circuit from the battery second terminal to the case second section to the case first section to the light bulb first terminal through the light bulb to the light bulb second terminal bulb back to the battery first terminal, energizing the light bulb from the battery and emitting light. This conventional construction, and operation, of a flashlight where an angular rotation of two flashlight sections relative to one another accomplishes the electrical on/off switching of the flashlight, is called "twist on/twist off".

In accordance with the first, electrical switching, aspect of the present invention, the spring between the battery's second terminal and the second section of the tubular flashlight case is improved. Namely, the force biasing and electrical conduction functions of the spring are separated.

An electrically-nonconducting member, normally a metal coil spring and insulating washer, serves to force bias the battery for movement within the tubular case so that the first one of its two terminals is in the continuous electrical contact with the second terminal of the light bulb. Meanwhile, an electrically-conducting member, normally another metal coil spring located coaxially with the first metal coil spring but insulated therefrom, electrically connects the second terminal of the battery to the second section of the two-section tubular case only when the case's two sections are angularly rotated relative to one another to greater than a predetermined second degree. The electrically-conducting member is normally a metal coil spring not so as to provide a biasing force to the movement of the battery within the case (which force is provided by the first coil spring of the electrically non-conducting member), but only so as to produce such a wiping force as permits good electrical contact. The reason why the electrically-conducting member, or second metal coil spring, makes electrical contact between the second terminal of the battery and the second section of the tubular case only upon sufficient rotation (to the predetermined second degree) of the case's two sections is simple. The second coil spring is shorter than the first coil spring. The two sections of the case must be screwed together, and the first coil spring compressed, to a sufficient degree before the second coil spring will span the entire gap between the second terminal of the battery and the second section of the tubular case.

Accordingly, and by this operation, the battery's second terminal makes electrical contact with the case's second section only when the case's two sections are angularly rotated relative to one another to greater than the predetermined second degree. Further by this operation, the electrical circuit is completed, and the light bulb is energized so as to emit light, only when the case's two sections are angularly rotated relative to one another to greater than the predetermined first degree or the predetermined second degree, whichever is largest. Typically the predetermined first and second degrees are equal to each other within 90° of angular rotation, and are more typically equal to each other within 10°. Each of the predetermined first and second degrees is typically equal to approximately 0 360, or one complete turn, of angular rotation between the two sections of the tubular flashlight case.

In accordance with the second aspect of the present invention, a removable and replaceable shock-resistance light bulb assembly for a flashlight is provided. The assembly includes a generally cylindrical miniature light bulb having a light-emitting filament and a base from which two electrical wire leads extend.

A generally cylindrical first member of an electrically-insulating shock-absorbing material, typically thermoplastic, encapsulates the light bulb within an interior cavity. The first member holds the light bulb with its filament exposed, typically between a number, normally four, arcuately-arrayed elongate "fingers". The first member presents a circumferential flange at one of its cylindrical ends. One of the two wire leads of the light bulb is routed substantially centrally axially through the body of cylindrical member to a first exterior position substantially at a geometric center of that same cylindrical end of the member which presents the flange. This wire routing permits that a first external electrical contact may subsequently be made at this first position.

The remaining one of the two wire leads of the light bulb is routed substantially radially through the body of cylindrical member to an second exterior position substantially along an exterior annulus of the flange and on a side of the flange that is opposite to that side at which the first electrical contact may be made. This wire routing permits that a second electrical contact may subsequently be made at this second position.

A generally cylindrical second member of an electrically-conducting rigid and strong material, typically machined aluminum, slides over the first member until it permanently sleeves the first member in a position abutting the first member's flange. In this position the second member securely holds the first member with the filament of the miniature light bulb exposed in a first axial direction. In this first direction the second member normally presents a precision, polished, paraboloidal reflective surface having the light bulb's spatially-minute filament at its focus. Because of the principles of optics, a very sharp, clean, light beam may subsequently be emitted. The second member also makes an electrical connection to a wire lead of the light bulb at the second position.

The light bulb that is held within the first member which is, in turn, held within the second member constitute, collectively and in combination, a replaceable assembly for use in a flashlight. The assembly is easily held and manipulated with the human hand and fingers. When emplaced in a flashlight of complimentary configuration the assembly provides a new bulb securely isolated against shock and precision-positioned relative to a new, shiny and untarnished, reflector surface. Massive metal surfaces of the second member permit excellent and reliable electrical contact to be made to the replaceable assembly, and to the miniature bulb held therein, even though the wire leads of the bulb itself (now encapsulated) are relatively small and delicate.

Both the redundant switches, and the shock-mounted light bulb assembly, of the present invention may be individually incorporated in flashlights of various types used for diverse purposes. In one particular, and preferred, usage, a flashlight in accordance with the present invention is provided with a strong, but lightweight, machined aluminum case having a screw-thread fitting at the exterior of its butt end. The flashlight may be securely screwed onto a complimentary fitting at the tip of a collapsible police baton, such as the batons taught within the aforementioned U.S. Pat. Nos. 4,752,072 issued Jun. 21, 1988, and 5,110,375 issued May 5, 1992. The flashlight so constructed and mounted is substantially impervious to damage or failure during the most extreme conditions of use and abuse, specifically including use in striking as part of a baton. Yet the flashlight may be readily be field stripped, and reassembled, by use of only the hands and fingers under adverse conditions of weather and/or darkness.

These and other aspects and attributes of the present invention will become increasingly clear upon reference to the following drawings and accompanying specification.

DESCRIPTION OF THE PREFERRED EMBODIMENT

Figure 1:
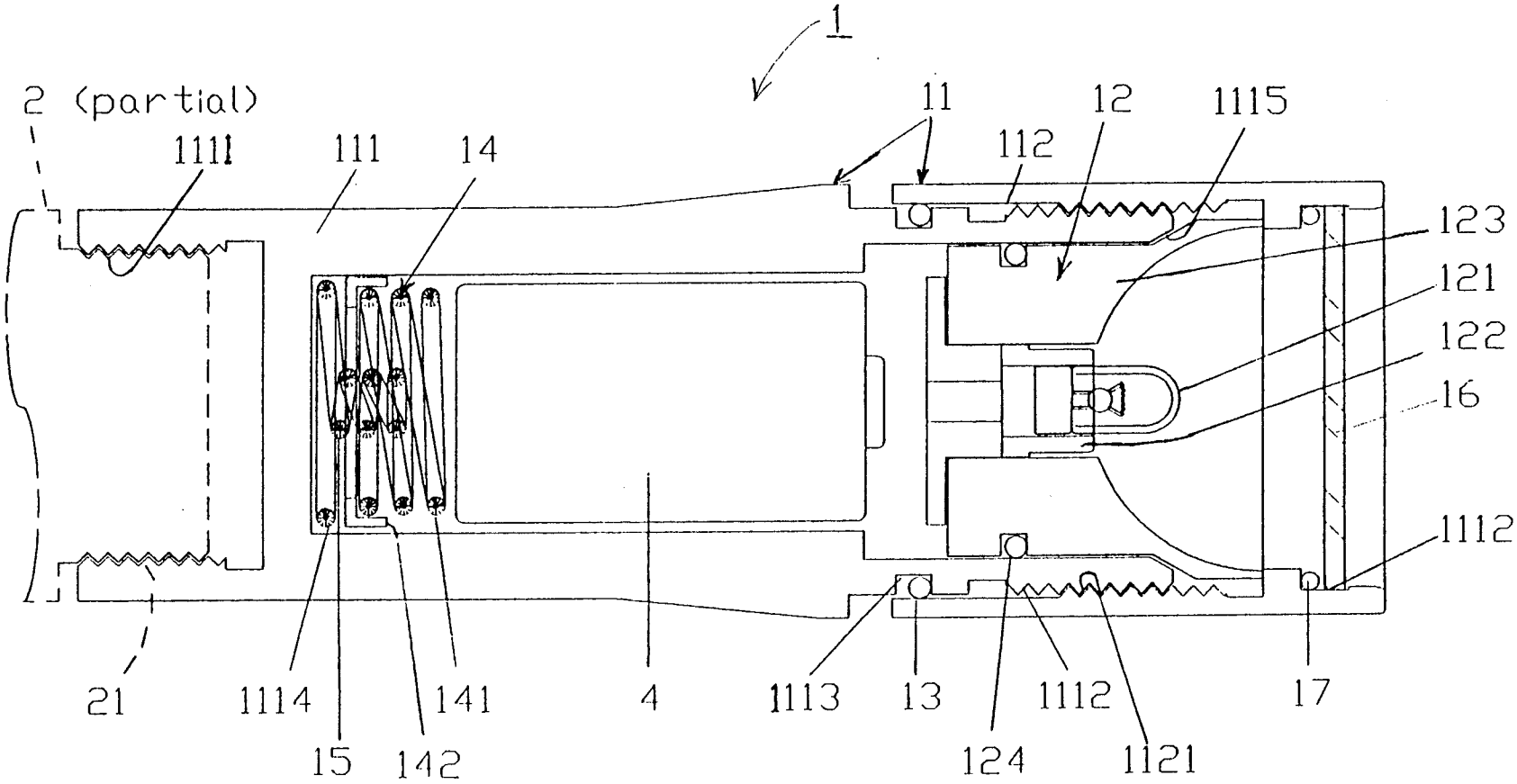
FIG. 1 is a cross-sectional view of a preferred embodiment of flashlight in accordance with the present invention.
Figure 2:
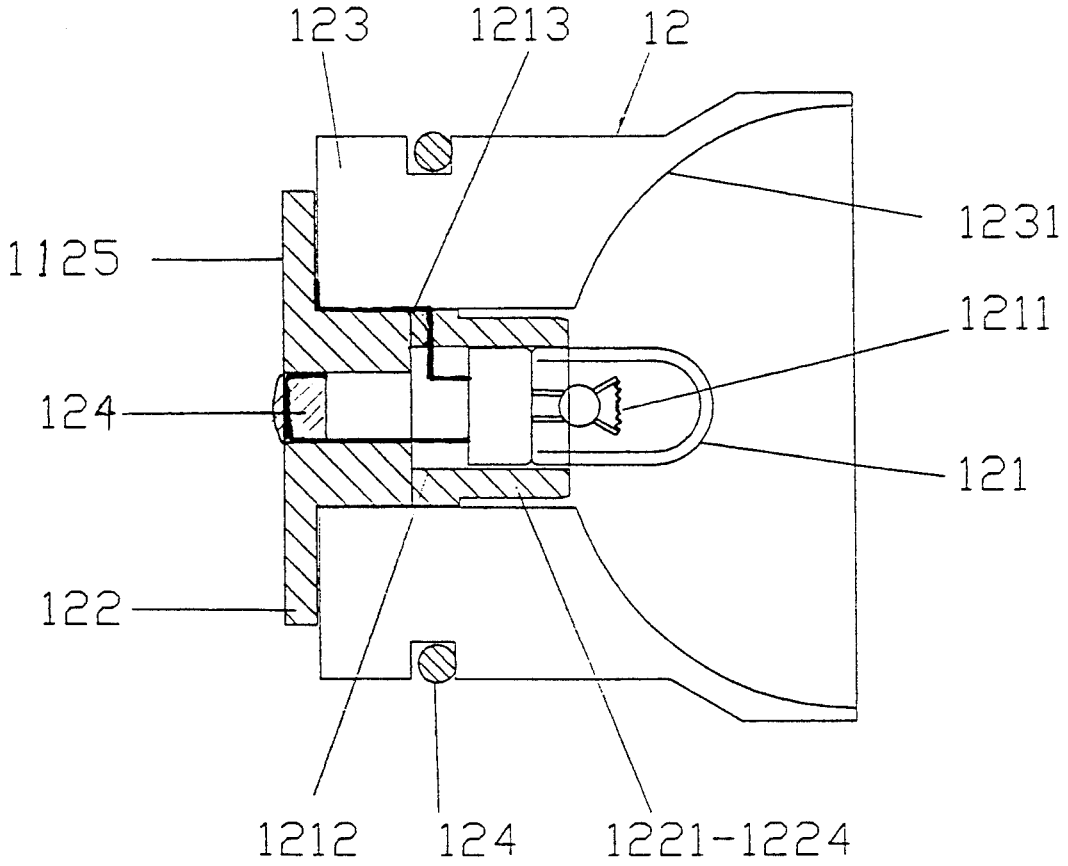
FIG. 2 is a detail diagram of the preferred shock-mounted light bulb assembly of the flashlight in accordance with the present invention previously seen in FIG. 1.

A preferred embodiment of a flashlight in accordance with the present invention is diagrammatically illustrated in FIG. 1. A detail view of the preferred construction of the shock-mounted bulb assembly of the flashlight is shown in FIG. 2, with a critical plastic component of that assembly further shown in FIG. 3. The new on/off switch of the flashlight is shown in detail view in FIGS. 4*a*–4*c*.

The flashlight 1 may optionally be mounted to the tip of a baton 2 (partial) which is shown in dashed line for not being part of the present invention. If so mounted, it is preferably by engagement of female screw threads 1111 at the exterior base of the battery-end section 111 of the tubular flashlight case 11 with complimentary male threads 21 upon the tip of baton 2 (partial) . If the flashlight 1 is not so mounted then a plug (not shown) with male threads may be mounted to the same female screw threads 1111 at the exterior base of the battery-end section 111 of the tubular flashlight case 11. Dependent upon the depth of the threads of such a plug (not shown) relative to threads 1111 a small cavity, or void, that is useful for storage of identification tags or other small items may be created between the plug and the base of the battery-end section 111 of the tubular flashlight case 11.

The battery-end section 111 of the tubular flashlight case 11 houses a battery 4 (shown in phantom line for not being part of the present invention). The battery 4 is preferably a 3 v.d.c. lithium battery, such as DURACELL ®XL TM (trademarks of DURACELL, Inc.) type DL2/3A available from Duracell, Inc., Bethel, Conn. 06801.

A light bulb-end section 112 of the tubular flashlight case 11 contains a light bulb assembly 12 (shown in greater detail in FIG. 2). The battery-end section 111 screws to the light bulb-end section 112, normally (but not invariably) by engagement of male threads 1112 upon the former section with the female threads 1121 upon the later section. An O-ring gasket 13 is preferably fitted within a circumferential groove, or channel, 1113 of the battery-end section 111. This O-ring gasket 13 serves to seal the battery-end section 111 watertight to the light bulb-end section 112 when they are screwed together.

The battery-end section 111 is metal, typically aluminum, and is normally fabricated by machining. It presents an anodized finish, typically black in color, everywhere upon its interior and exterior surfaces save for two locations, only. The interior base 1114 of the butt end, and the annular surface 1115, are exposed native metal. The anodized surfaces are electrically insulating whereas the exposed native metal surfaces are electrically conducting, as is the battery-end section 111 itself.

The battery 4 within the battery-end section 111 is urged in the direction of light bulb-end section 112. In accordance with a first aspect of the present invention—the consequences of which will be further explained later—this transpires by action of an assembly 14 consisting of a spring 141 and an insulating washer 142. For the purposes of the present invention it is necessary to understand that this assembly 14 is electrically non-conductive between its contacts to the terminal of the battery 4, and the native metal interior base 1114 of the butt end of the battery-end section 111. Such force biasing without electrical conduction could be alternatively obtained, for example, by use of an electrically non-conductive spring,,such as one made of plastic.

Meanwhile, another, further, component exists within the battery-end section 111 in the small space between the battery 4 and the native metal interior base 1114. This component is normally an electrically-conductive metal spring 15. The spring 15 is affixed to, and maintained in electrical conductivity with, the native metal interior base 1114—normally by action of the spring assembly 14 which sits on top of the spring 15. Importantly to the present invention, the spring 15 is shorter in length than the spring 141 of spring assembly 14, meaning that its normal extension is less than the extension of the spring 141 of the assembly 14. Also importantly to the present invention, the spring 14 does not contact any electrically conductive portion of the assembly 14 (e.g., the spring 141 of the assembly 14), normally because the exterior diameter of the coil of spring 15 is smaller than the interior diameter of the coil of spring 141.

It should be understood that the spring 15 is not used for imparting positional biasing forces to battery 4. The spring 14 could have been, alternatively, a mere pylon of metal, or a stud, or an erect pin. The use of the spring 14 provides a useful wiping force during electrical contact of the spring with the battery 4, in a manner and under circumstances to be explained.

The light bulb-end section 112, normally also of machined aluminum metal, is completely anodized, typically to a black color, everywhere upon its interior and exterior surfaces. The light bulb-end section 112 semi-permanently compressively mounts and retains a lens 16, normally made of scratch-resistance hard plastic, in a channel 1122 that is slightly recessed from the tip of the light bulb-end section 112 of the case 11. The case 11 is rendered water- and gas-tight at the location of lens 16 and channel 1112 by O-ring 17. The light bulb assembly 12 is rendered water- and gas-tight, and is stabilized with a modest degree of elasticity and shock absorption, in its location within the light bulb-end section 112 by the O-ring 124.

Figure 3A:
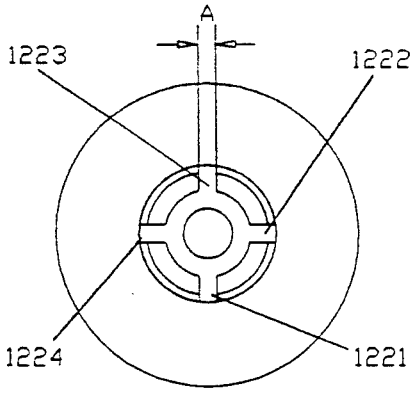
FIG. 3*a* is a top view.

The light bulb assembly 12 my be observed in greatest detail in FIG. 2. A miniature light bulb 121 is permanently mounted within the assembly 12. It is so mounted by the generally cylindrical first member 122. This first member 122 is made of an electrically-insulating shock-absorbing material, typically thermoplastic. It holds the light bulb 121 with its filament 1211 exposed to the exterior of assembly 12, and through the lens 16 to the exterior of case 11 and flashlight 1 (all shown in FIG. 1). The holding is effected between a number, normally four, arcuately-arrayed elongate "fingers" 1221–1224 that are best seen in FIG. 3*a*.

The first member 122 also has a circumferential flange 1225. Wire lead 1212 of the light bulb 121 is routed substantially centrally axially through the body of first member 122 to the illustrated first exterior position substantially at a geometric center of the cylindrical end of the member 122. The remaining wire lead 1213 of two such from the light bulb 121 is routed substantially radially between any two of the fingers 1221–1224 and through the body of cylindrical first member 122 to the illustrated exterior position substantially along an exterior annulus of the circumferential flange 1225. This location is, of course, on a side of the flange 1225 that is opposite to that side whereat appears the wire lead 1212.

Continuing in FIG. 2, a generally cylindrical second member 123 slides over the first member 122 until it sleeves the first member 122 in a position abutting the flange 1223. The second member 123 is necessarily made of an electrically-conducting material, and is preferably made of a material that is also rigid and strong, more preferably machined aluminum. In its mounted position the second member 123 securely holds the first member 122 with the filament 1211 of the miniature light bulb 121 exposed in a first axial direction. The second member 123 presents a precision, polished, and typically spheroidal or paraboloidal reflective surface 1231 in this direction. The spatially-minute filament 1211 of the light bulb 121 is at the focus of this paraboloid. Because of the principles of optics, light emissions from the filament 1211 of the light bulb 121 are focused to a very sharp, clean, collimated light beam precisely in the axial direction.

The second member 123 makes an electrical connection to the wire lead 1213 of the light bulb 121 at the position of its flange 1225. The second member 123 is electrically insulated by the electrically non-conducting first member 122 from the other wire lead 1212 of the light bulb 121. However, in order to facilitate that other things (namely the battery 4, as hereinafter explained) should ultimately make electrical contact with the wire lead 1212 of the light bulb 121, a small, headed, electrically-conductive pin 125, substantially in the shape of a rivet, is pressured or otherwise fitted within an axial cavity of complimentary size and shape within the first member 122, and against the wire lead 1212.

Figure 3B:
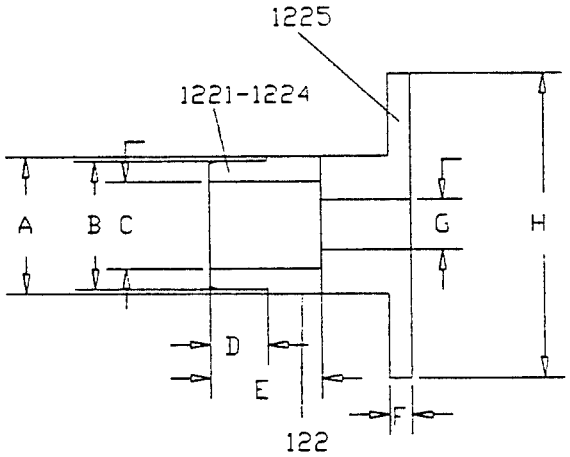
FIG. 3*b* is a cross-sectional side view, of the plastic member of the preferred shock-mounted light bulb assembly of the flashlight in accordance with the present invention previously seen in FIG. 2.

The first member 122, which is important to realizing the shock-absorbing aspect of the present invention, is further shown in detail end view in FIG. 3*a*, and in detail cross-sectional view in FIG. 3*b*. The four support fingers 1121–1124 are visible in FIG. 3*a*. Dimension A in FIG. 3*b* is typically 0.305 inches, whereas dimension B is typically 0.280 inches. Accordingly, the fingers 1221–1224 of the first member are very slightly separated from the encapsulating second member 123 (shown in FIG. 2) and provide thereby relief from high G shock forces. Dimensions C-H shown in FIG. 3*b* are typically respectively 0.192", 0.130", 0.25", 0.005", 0.100" and 0.675".

Figure 4A:
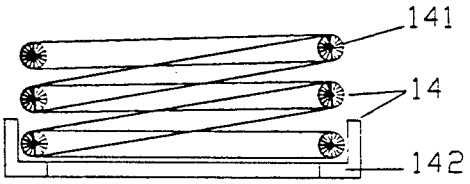
FIG. 4*a* is a side view, partially in cut-away, of the electrically non-conducting member of a second on/off switch of the flashlight in accordance with the present invention previously seen in FIG. 1.
Figure 4B:
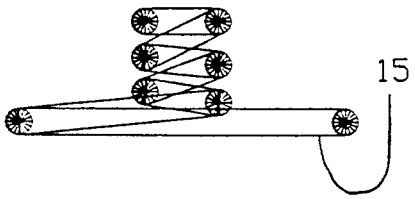
FIG. 4*b* is a side view of the electrically conducting member of a second on/off switch of the flashlight in accordance with the present invention previously seen in FIG. 1.
Figure 4C:
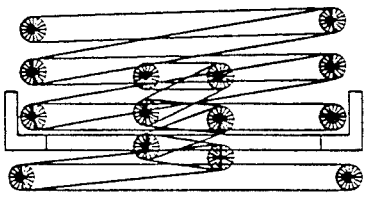
FIG. 4*c* is a side view of the electrically non-conducting member previously seen in FIG. 4*a*, and also of the electrically conducting member previously seen in FIG. 4*b*, assembled together to form the second on/off switch of the flashlight in accordance with the present invention previously seen in FIG. 1.

The second on/off switch—in addition to the switching provided between the surface 1105 and the light bulb assembly 12/light bulb-end case section 112 (shown in FIG. 1) in a manner to be explained—of the present invention is shown in its two sub-assemblies in FIGS. 4*a* and 4*b*, and assembled in FIG. 4*c*. The electrically non-conducting member 14 of a second on/off switch of the flashlight in accordance with the present invention is shown in side view, partially in cut-away, within FIG. 4*a*. The member 14 typically consists of an electrically-conductive, metal, spring 14 and an insulating washer 142. It must act to provide expansion force, but it must not be electrically conducting from one end to the other. Obviously, alternative constructions such as springs of plastic would satisfy these criteria.

The electrically conducting member 15 of the second on/off switch of the flashlight in accordance with the present invention is shown in side view in FIG. 4*b*. Note that its elongate extent is not so great as is the electrically non-conducting member shown in FIG. 4*a*.

A side view of the electrically non-conducting member 14 previously seen in FIG. 4*a*, assembled to the electrically conducting member previously seen in FIG. 4*b* to form the complete second on/off switch of the flashlight in accordance with the present invention is seen in FIG. 4*c*.

Returning to FIG. 1, part of the operation of a flashlight 1 in accordance the present invention is conventional insofar as the action of the assembly 141 serves to push the battery 4 (both assembly and battery which are within the battery-end section 111) in the direction of light bulb-end section 112. In FIG. 1 the tubular case sections 111, 112 of the flashlight 1 are unscrewed several turns, and to such a great extent that the battery 4 is not in contact with the electrically-conductive pin 124. Normally, and under more tightly screwed, operational, conditions the case sections 111, 112 are sufficiently screwed together so that the force biasing action of the assembly 14 against the battery 4 serves to keep the battery 4 in constant contact with the electrically-conductive pin 125, and the wire lead 1212 of the light bulb 121, regardless of whether the battery-end section 111 is screwed completely into, or is backed off a turn or so, from the light bulb-end section 112.

In accordance with a first aspect of the present invention, the extent to which the battery-end section 111 is screwed into the light bulb-end section 112, makes and breaks two separate electrical switches. The more conventional of these switches may be recognized as the mating contact between the native metal annular surface 1115 of the battery-end section 111 and the complimentary native metal surface of the second member 123 of the light bulb assembly 12. These surfaces are, of course, normally urged to separation by the force of force biasing assembly 14 (i.e., by the contained spring 141 of this assembly) acting—through the physical body of battery 4, and the headed pin 125 and first member 122 of light bulb assembly 12—between the battery-end section 111 and the second member 123. These surfaces are, of course, forced into electrical contact only when the battery-end section 111 is screwed into the light bulb-end section 112 to a sufficient extent, normally about 1.0 turn (360°) from mechanical tight lock.

The second electrical switch is likewise made, and broken, by the extent to which the battery-end section 111 is screwed into the light bulb-end section 112. This switch is between the spring 15 (and all that it continually electrically contacts including the battery-end section 111) and the opposed terminal of the battery 4. Only when the battery-end section 111 is screwed into the light bulb-end section 112 (against the biasing force of the biasing assembly 14) to a predetermined extent will the normal gap between the spring 15 and the opposed terminal of battery 4 be closed, and electrical continuity made.

The two electrical switches are in electrical series. Both must be made in order to energize the light bulb 121 from the battery 4. Conversely, either switch can be broken in order to turn the flashlight 1 off. One utility of having dual, series-connected, electrical switches may be assessed if it is considered what will electrically transpire if, over time and after wear, the insulating anodizing is worn from the threaded surfaces of the battery-end section 111 and the light bulb-end section 112. An electrical path to the light bulb 121 through these surfaces would prevent that the flashlight should be turned off save for the action of the second, redundant, switch enabled by assembly 14 and spring 15.

The two electrical switches both operate by the angular rotation of, and the screwed engagement of, the battery-end section 111 and light bulb-end section 112. The point, and the relative angular movement, at which each of the two switches both engages and disengages could be independent, and separately predetermined for each switch. In accordance with the present invention, both switches are designed to turn on, and to turn off, at the same degree of angular rotation, and screwed engagement, of the battery-end section 111 and light bulb-end section 112. The consumer/user of the flashlight 1 need not be concerned with the workings of the switches.

In accordance with the preceding explanation, alternative constructions, and modifications, of the flashlight in accordance with the present invention will suggest themselves to a practitioner of the electromechanical design arts. For example, the concept of low-cost, low-mass, high-reliability redundant switching in a device so elementary as a twist-on/twist-off flashlight having been put forward in this specification, it is an easy matter to design switches, and circuit paths, that are redundant for turning the flashlight on (as opposed to off, as in the present invention).

For example, alternative constructions of a modular replaceable shock-mount assembly for a miniature flashlight bulb might use a suspension, or an elastomeric material, shock mounting for the bulb.

For example, the relative motion serving to compress the new second on/off switch need not transpire solely by rotation between the sections 111, 112 of case 11. Instead, a plunger, a mechanical rocker, or other mechanism could be located behind the butt end of the case section 111, and in the location of the baton 2 (partial) (shown in FIG. 1). Finger-activated depression of such a mechanism would operate to move a rod, or plunger, through an axial bore located in the base of case section 111, and so as to force the spring assembly towards the battery 4. In such a manner still another manually activated on/off switch would be created. A flashlight 1 so expanded, and extended, by still further application of the principles of the present invention would have two complete, and redundant, means of manual actuation.

Even if the case 11 became so distorted and damaged so that its sections 111, 112 would no longer screw together, a new switch at the butt end of the case 11 could still move the spring assembly 14, and spring 15, so as to selectively energize the light bulb 121.

According to these and other alterations and adaptations, the present invention should be interpreted broadly, and in accordance with the following claims only, and not solely in accordance with that particular embodiment within which the invention has been taught.

What is claimed is:

1. In a flashlight having a tubular case having two electrically-conducting sections which screw together until, the relative angular rotation between the two sections exceeding a predetermined first degree, the two sections are placed into electrical contact, a light bulb, located within a first end portion of the two-section tubular case and having two terminals a first one of which is in continuous electrical contact with a first section of the two-section tubular case, for emitting light when energized, a battery, located and moveable within an opposite end portion of the two-section tubular case and having two terminals, for supplying energy, and spring means for (i) force biasing the battery for movement within the tubular case so that a first one of its two terminals is in continuous electrical contact with a second terminal of the light bulb, and f or (ii) electrically connecting the second terminal of the battery to the second section of the two-section tubular case, wherein an angular rotation of the two sections exceeding the predetermined first degree places the two electrically-conducting sections of the tubular case into electrical contact, completing an electrical circuit from the battery second terminal to the case second section to the case first section to the light bulb first terminal through the light bulb to the light bulb second terminal bulb back to the battery first terminal and energizing the light bulb from the battery so that it emits light, wherein angular rotation of the two sections relative to one another constitutes an electrical on/off switching of the flashlight, an improvement to the spring means comprising:

electrically-nonconducting means for force biasing the battery for movement within the tubular case so that a first one of its two terminals is in the continuous electrical contact with a second terminal of the light bulb; and electrically-conducting means for electrically connecting the second terminal of the battery to the second section of the two-section tubular case only when the case's two sections are angularly rotated relative to one another to greater than a predetermined second degree;

wherein the battery second terminal makes electrical contact with the case second section only when the case's two sections are angularly rotated relative to one another to greater than the predetermined second degree;

wherein the electrical circuit is completed, and the light bulb energized so as to emit light, only when the case's two sections are angularly rotated relative to one another to greater than the largest of the predetermined first degree and the predetermined second degree.

2. The improvement to the spring means of a flashlight according to claim 1 wherein the electrically-nonconducting means comprises:

a metal coil spring having ends and a longitudinal axis of rotation; and an insulating washer concentric with the longitudinal axis of rotation of the metal coil spring, and located at one end of the metal coil spring.

3. The improvement to the spring means of a flashlight according to claim 1 wherein the electrically-conducting means, comprises:

an electrically conductive member affixed to, and electrically conductive with, a one of the battery and the second section of the tubular case at a position between them;

wherein the electrically conductive member extends across a gap between the battery and the second section of the tubular case the dimension of which gap is variable dependent upon the screwing together of the two sections of the tubular case;

wherein, by a magnitude of the extension of the electrically conductive member and of such remainder of the gap between the battery and the case as the member does not span, and by a diameter of the case and a pitch of a screwed engagement of the case's two sections, the amount of said second degree of relative rotation between the two sections of the case is predetermined.

4. The flashlight according to claim 3 wherein the electrically conductive member comprises:

a coil spring.

5. The improvement to the spring means of a flashlight according to claim 1 wherein the electrically-conducting means comprises:

a coil spring.

6. The improvement to the spring means of a flashlight according to claim 1 wherein the tubular case comprises:

mounting means for removeably mounting the case to a baton.

7. A flashlight comprising:

a tubular case having two, a light bulb-end and a battery-end, electrically-conducting tubular sections threaded to each other so as to, by angular rotation relative to one another, screw into each other to a variable extent;

an electrically insulating means for electrically insulating the electrically-conducting light bulb-end section and the battery-end section from one another over the region of their threaded engagement;

an electrical connection means for, normally and in the absence of failure, electrically connecting the light bulb-end section to the battery-end section only upon such times as they are screwed together to a first predetermined extent, constituting by this action a first electrical switch;

a light bulb, capable of being energized by a battery, located within the light-bulb-end section of the tubular case;

a battery, suitable to energize the light bulb, located and longitudinally moveable within the battery-end section of the tubular case at a position that is, from, time to time, variously proximately to or distant from, and in respective electrical continuity or electrical non-continuity with, an interior butt end of said battery-end section of the tubular case dependent upon whether the light-bulb-end and battery-end sections of the tubular case are screwed together to, respectively, a greater or a lessor degree; and an electrically non-conducting spring means, located within the battery-end section of the tubular case between its interior butt end and the battery, for force biasing the battery to physical separation from, and electrical non-continuity with, the interior butt end of the battery-end section of the tubular case;

an electrically conductive member affixed to, and electrically conductive with, a one of the battery and the interior butt end of the battery-end section of the tubular case at a position between them, the electrically conductive member extending across some of a variable gap between the battery and the interior butt end of the battery-end section of the tubular case;

wherein the battery makes electrical connection to the butt end of the battery-end section of the tubular case through the electrically conductive member only upon such times as the light-bulb-end and battery-end sections of the tubular case are screwed together to a second extent, constituting by this action a second electrical switch;

wherein, dependent upon the magnitude of the extension of the electrically conductive member and of such remainder of the gap between the battery and the case as the member does not span, and further dependent upon a diameter of the case and a pitch of the threading engagement of the light-bulb-end section and the battery-end section of the case, the amount of said second extent of relative rotation between the light-bulb-end section and the battery-end section of the case as will actuate the second electrical switch is predetermined;

wherein there are two separate, the first and the second, electrical switches located in electrical series within an electrical path between the battery and the light bulb, both of which switches must respectively be closed by rotation of the light-bulb-end section and the battery-end section of the tubular case relative to one another by a greater of the first predetermined extent and the second predetermined extent before, both switches being closed, the light bulb is energized from the battery.

8. The flashlight according to claim 7 wherein the spring means comprises:

a metal coil spring having ends and a longitudinal axis of rotation; and an insulating washer concentric with the longitudinal axis of rotation of the metal coil spring, and located at one end of the metal coil spring.

9. The flashlight according to claim 7 wherein the electrically conductive member comprises:

a coil spring

10. The flashlight according to claim 9 wherein the metal coil spring has a longitudinal axis of rotation; and wherein the spring means comprises:

another, second, metal coil spring having ends and a longitudinal axis of rotation coaxial with the longitudinal axis of the metal coil spring; and an insulating washer concentric with the longitudinal axis of rotation of both metal coil springs, and located at one end of the second metal coil spring.

11. The flashlight according to claim 10 wherein the metal coil spring fits inside the coil of the second coil spring, which second coil spring is of a larger diameter than the coil spring.

12. The flashlight according to claim 7 wherein the electrically conductive member extends across approximately $\frac{1}{4}$ inches of an approximate $\frac{3}{8}$ inch maximum gap between the battery and the butt end of the battery-end section of the tubular case, making thereby that the remainder of the gap equals approximately $\frac{1}{8}$ inch.

13. The flashlight according to claim 12 wherein the diameter of the tubular case is approximately 1 inch, and the pitch of the threading engagement is approximately 10°, making thereby that the approximate $\frac{1}{8}$ inch remainder of the gap is taken up by approximately 360° of angular rotation, or approximately one complete rotation, between the light-bulb-end section and the battery-end section of the case.

14. The flashlight according to claim 7 wherein the first predetermined extent equals the second angular extent within 90° of angular rotation.

15. The flashlight according to claim 7 wherein the tubular case comprises:

mounting means for removeably mounting the case to a baton.

16. A method of electrically switching a battery power source to a light bulb within a flashlight, the flashlight on/off switching method comprising:

threading two, a light-bulb-end and a battery-end, electrically-conducting sections of a tubular flashlight case together so as to, by a manual rotation of the sections relative to one another, screw one section into the other to a variable extent;

electrically insulating the light-bulb-end section from the battery-end section in and during the course of their threaded engagement, making electrical connection between the two electrically-conducting sections only upon such times as they are screwed together to a first predetermined extent, constituting by this action a first electrical switching;

locating a light bulb, energized by a battery, within the light-bulb-end section of the tubular case;

locating a battery, suitable to energize the light bulb, in a longitudinally moveable position within the battery-end section of the tubular case, the battery assuming, from, time to time, a position variously proximate to or distant from, and in respective electrical continuity or electrical non-continuity with, a butt end of said battery-end section of the tubular case dependent upon whether the light-bulb-end and battery-end sections of the tubular case are screwed together to, respectively, a greater or a lessor degree; and locating a spring within the battery-end section of the tubular flashlight case at a position between the battery and the butt end of the battery-section of the case, the spring being itself perpetually electrically non-conducting between the battery and any portion of the case under all conditions of compression or extension;

force biasing with the spring the battery to physical separation from, and electrical non-continuity with, the butt end of the battery-end section of the tubular case;

affixing an electrically conductive member to, and in electrical conductivity with, a one of the battery and the interior butt end of the battery-end section of the tubular case at a position between them, the electrically conductive member so affixed extending across some of a variable gap between the battery and the interior butt end of the battery-end section of the tubular case;

wherein the battery makes electrical connection to the butt end of the battery-end section of the tubular case through the electrically conductive member only upon such times as the light-bulb-end section and the battery-end section of the tubular case are screwed together to a second extent, constituting by this action a second electrical switching;

wherein, dependent upon the extension of the electrically conductive member and the length of such remainder of the gap between the battery and the case as the member does not span, and further dependent upon a diameter of the case and a pitch of the threading engagement of the light-bulb-end section and the battery-end section of the case, the amount of said second extent of relative rotation between the light-bulb-end section and the battery-end section of the case as will actuate the second electrical switch is predetermined;

wherein the first and the second electrical switching transpires in electrical series in an electrical path between the battery and the light bulb;

wherein both the first and the second electrical switching must establish continuity responsively to a rotation of the light-bulb-end and the battery-end sections of the tubular case relative to one another each by an associated predetermined extent before the light bulb is energized from the battery.

17. A removable and replaceable light bulb assembly for a flashlight comprising:

a generally cylindrical light bulb having a light-emitting filament and a base from which two electrical wire leads extend;

a generally cylindrical first member of an electrically-insulating shock-absorbing material, the first member having and presenting an interior cavity adapted and conformed for holding the light bulb with its filament exposed, and a circumferential flange at one cylindrical end, wherein one of the two wire leads of the light bulb is routed substantially centrally axially through the body of cylindrical member to a first exterior position substantially at a geometric center of that end of the member whereat exists the flange, thus permitting that a first external electrical contact may subsequently be made at this first position, and wherein the remaining one of the two wire leads of the light bulb is routed substantially radially through the body of cylindrical member to an second exterior position substantially along an exterior annulus of the flange and on a side of the flange that is opposite to that side at which the first electrical contact may be made, thus permitting that a second electrical contact may subsequently be made at this second position; and a generally cylindrical second member of an electrically-conducting rigid and strong material, the second member adapted and conformed for sliding over and the first member until it sleeves the first member in a position abutting the first member's flange, the second member securely holding the first member with the filament of the light bulb exposed in a first axial direction, and with electrical connection to a wire lead of the light bulb at the second position;

wherein the light bulb held within the first member held within the second member constitute, collectively and in combination, a replaceable assembly for use in a flashlight.

18. The light bulb assembly for a flashlight according to claim 17 wherein the generally cylindrical first member has and presents, as the defining structure of its cavity whereat is held the light bulb, a plurality of fingers separated by elongate longitudinal slots and longitudinally arrayed so as to embrace and hold the generally-cylindrical light bulb.

19. The light bulb assembly for a flashlight according to claim 17 wherein plurality of fingers of the generally cylindrical first member comprise:

two fingers with concave curved surfaces disposed towards the held light bulb.

20. The light bulb assembly for a flashlight according to claim 17 further comprising:

an electrically-conducting headed pin, substantially in the shape of a rivet, inserted within the first member at the site of its second exterior position substantially along an exterior annulus of the flange, making at this position the second electrical contact with the head of the pin disposed to the exterior of the first member;

wherein during use of the light bulb assembly within a flashlight electrical connection may be made to the head of the pin in lieu of the wire lead of the light bulb.

21. The light bulb assembly for a flashlight according to claim 17 wherein the second member further has and defines a reflective surface radially around the filament of the light bulb that is held within the first member.

22. The light bulb assembly for a flashlight according to claim 21 wherein the second member's reflective surface is parabolic in cross section with the filament of the light bulb located at the focus of the parabola.

23. The light bulb assembly for a flashlight according to claim 17 fitted within a flashlight case of complimentary physical and electrical configuration.

24. The light bulb assembly for a flashlight according to claim 23 wherein the flashlight case within which the light bulb assembly is fitted comprises:

mounting means for removeably mounting the case to a baton.

25. A flashlight comprising:

a tubular case having two, a light bulb-end and a battery-end, electrically-conducting tubular sections threaded to each other so as to, by angular rotation relative to one another, screw into each other to a variable extent;

an electrically insulating means for electrically insulating the electrically-conducting light bulb-end section and the battery-end section from one another over the region of their threaded engagement;

an electrical connection means for, normally and in the absence of failure, electrically connecting the light bulb-end section to the battery-end section only upon such times as they are screwed together to a first predetermined extent, constituting by this action a first electrical switch;

a removable and replaceable light bulb assembly. capable of being energized by a battery and located within the light-bulb-end section of the tubular case, the assembly including a generally cylindrical light bulb having a light-emitting filament and a base from which two electrical wire leads extend;

a generally cylindrical first member of an electrically-insulating shock-absorbing material, the first member having and presenting an interior cavity adapted and conformed for holding the light bulb with its filament exposed, and a circumferential flange at one cylindrical end, wherein one of the two wire leads of the light bulb is routed substantially centrally axially through the body of cylindrical member to a first exterior position substantially at a geometric center of that end of the member whereat exists the flange, thus permitting that a first external electrical contact may subsequently be made at this first position, and wherein the remaining one of the two wire leads of the light bulb is routed substantially radially through the body of cylindrical member to an second exterior position substantially along an exterior annulus of the flange and on a side of the flange that is opposite to that side at which the first electrical contact may be made, thus permitting that a second electrical contact may subsequently be made at this second position; and a generally cylindrical second member of an electrically-conducting rigid and strong material, the second member adapted and conformed for sliding over and the first member until it sleeves the first member in a position abutting the first member's flange, the second member securely holding the first member with the filament of the light bulb exposed in a first axial direction, and with electrical connection to a wire lead of the light bulb at the second position;

wherein the light bulb held within the first member held within the second member constitute, collectively and in combination, a replaceable assembly;

a battery, suitable to energize the light bulb of the light-bulb assembly, located and longitudinally moveable within the battery-end section of the tubular case at a position that is, from, time to time, variously proximately to or distant from, and in respective electrical continuity or electrical non-continuity with, an interior butt end of said battery-end section of the tubular case dependent upon whether the light-bulb-end and battery-end sections of the tubular case are screwed together to, respectively, a greater or a lessor degree; and an electrically non-conducting spring means, located within the battery-end section of the tubular case between its interior butt end and the battery, for force biasing the battery to physical separation from, and electrical non-continuity with, the interior butt end of the battery-end section of the tubular case;

an electrically conductive member affixed to, and electrically conductive with, a one of the battery and the interior butt end of the battery-end section of the tubular case at a position between them, the electrically conductive member extending across some of a variable gap between the battery and the interior butt end of the battery-end section of the tubular case;

wherein the battery makes electrical connection to the butt end of the battery-end section of the tubular case through the electrically conductive member only upon such times as the light-bulb-end and battery-end sections of the tubular case are screwed together to a second, constituting by this action a second electrical switch;

wherein, dependent upon the extension of the electrically conductive member and the length of such remainder of the gap between the battery and the case as the member does not span, and further dependent upon a diameter of the case and a pitch of the threading engagement of the light-bulb-end section and the battery-end section of the case, the amount of said second extent of relative rotation between the light-bulb-end section and the battery-end section of the case as will actuate the second electrical switch is predetermined;

wherein there are two separate, the first and the second, electrical switches located in electrical series within an electrical path between the battery and the light bulb, both of which switches must respectively be closed by rotation of the light-bulb-end section and the battery-end section of the tubular case relative to one another by a greater of the first predetermined extent and the second predetermined extent before, both switches being closed, the light bulb is energized from the battery.

* * * * *